US011213087B2

(12) United States Patent
Hyma

(10) Patent No.: US 11,213,087 B2
(45) Date of Patent: Jan. 4, 2022

(54) HARD HAT LAMP ATTACHMENT SYSTEM

(71) Applicant: Milwaukee Electric Tool Corporation, Brookfield, WI (US)

(72) Inventor: Steven W. Hyma, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/706,410

(22) Filed: Dec. 6, 2019

(65) Prior Publication Data

US 2020/0154811 A1 May 21, 2020

Related U.S. Application Data

(63) Continuation of application No. PCT/US2019/062464, filed on Nov. 20, 2019.

(60) Provisional application No. 62/770,466, filed on Nov. 21, 2018.

(51) Int. Cl.
*A42B 3/04* (2006.01)

(52) U.S. Cl.
CPC ..... *A42B 3/044* (2013.01); *A42B 3/042* (2013.01); *A42B 3/0406* (2013.01); *A42B 3/0426* (2013.01); *A42B 3/0446* (2013.01)

(58) Field of Classification Search
CPC ..... A42B 3/0406; A42B 3/042; A42B 3/0426; A42B 3/044; A42B 3/0446
See application file for complete search history.

(56) References Cited

U.S. PATENT DOCUMENTS

| | | | |
|---|---|---|---|
| 4,002,895 | A | 1/1977 | Ketler |
| 4,521,831 | A | 6/1985 | Thayer |
| 5,683,831 | A | 11/1997 | Baril |
| 6,811,348 | B1 | 11/2004 | Meyer |

(Continued)

FOREIGN PATENT DOCUMENTS

| | | |
|---|---|---|
| CN | 202853494 | 4/2013 |
| JP | 2009-127187 | 6/2009 |

(Continued)

OTHER PUBLICATIONS

International Search Report and Written Opinion for International Application No. PCT/US2019/062464, dated Mar. 10, 2020, 12 pages.

(Continued)

*Primary Examiner* — Thomas M Sember
(74) *Attorney, Agent, or Firm* — Reinhart Boerner Van Deuren s.c.

(57) ABSTRACT

A hard hat with symmetric front and back mounting ridges to support a headlamp is described. The hard hat provides mounting ridges to receive insertion slots of a rigid mounting bracket that fit around the ridges. The rigid mounting bracket includes channels to loop a strap through the channels and support a lamp on the bracket. The strap may include a hook and loop fastener system to enable attachment of a variety of lamps to the rigid support bracket. In this way, the hard hat can support a wide variety of headlamps attached to the rigid mounting bracket without destructive alterations to the hard hat. Clips may be added to the rigid mounting bracket to secure or lock the bracket in place during operation and prevent accidental knocks or jarring of the headlamp.

19 Claims, 20 Drawing Sheets

(56) References Cited

U.S. PATENT DOCUMENTS

| | | | | |
|---|---|---|---|---|
| 6,957,449 | B2 | 10/2005 | Prendergast | |
| 7,963,426 | B2 | 6/2011 | Gruebel et al. | |
| 7,996,917 | B2 | 8/2011 | Prendergast | |
| 8,117,676 | B1 | 2/2012 | Cardoso | |
| 8,677,516 | B2 | 3/2014 | Prendergast | |
| 8,908,389 | B2 | 12/2014 | Teetzel | |
| 9,047,790 | B1 | 6/2015 | Duderstadt | |
| 9,101,175 | B2 | 8/2015 | Redpath | |
| 9,532,621 | B2 | 1/2017 | Redpath | |
| 9,702,534 | B1 | 7/2017 | Brion | |
| 9,829,182 | B1 | 11/2017 | Mccaslin | |
| 10,334,902 | B2 | 7/2019 | Vilone | |
| 2006/0174401 | A1 | 8/2006 | Prendergast | |
| 2007/0212930 | A1 | 9/2007 | Gruebel et al. | |
| 2009/0077721 | A1 | 3/2009 | Prendergast | |
| 2011/0252546 | A1 | 10/2011 | Junker | |
| 2012/0057331 | A1* | 3/2012 | Janice | F21L 4/04 362/105 |
| 2012/0182748 | A1 | 7/2012 | Mccaslin | |
| 2012/0320569 | A1 | 12/2012 | Lu | |
| 2013/0086722 | A1 | 4/2013 | Teetzel | |
| 2013/0194784 | A1 | 8/2013 | Yu | |
| 2014/0000013 | A1 | 1/2014 | Redpath et al. | |
| 2014/0130241 | A1 | 5/2014 | Abdollahi | |
| 2014/0252188 | A1* | 9/2014 | Webster | F16M 11/06 248/229.17 |
| 2015/0223540 | A1 | 8/2015 | Daniels | |
| 2015/0305425 | A1 | 10/2015 | Redpath et al. | |
| 2016/0208982 | A1 | 7/2016 | Sharron | |
| 2017/0303619 | A1 | 10/2017 | Silva | |
| 2018/0292178 | A1 | 10/2018 | Gehring | |
| 2019/0231016 | A1 | 8/2019 | Deshpande et al. | |
| 2020/0329806 | A1 | 10/2020 | Wong | |
| 2020/0366872 | A1 | 11/2020 | Vettese | |

FOREIGN PATENT DOCUMENTS

| | | |
|---|---|---|
| JP | 2018-087401 | 6/2018 |
| KR | 20-2013-0003414 | 6/2013 |

OTHER PUBLICATIONS

Photos of Zenith helmet from KASK S.p.a believed to be commercially available prior to Nov. 21, 2018, 4 pages.

* cited by examiner

HARD HAT LAMP ATTACHMENT SYSTEM

CROSS-REFERENCE TO RELATED PATENT APPLICATION

The present application is a continuation of International Application No. PCT/US2019/062464 filed on Nov. 20, 2019, which claims the benefit of and priority to U.S. Provisional Application No. 62/770,466 filed on Nov. 21, 2018, which are incorporated herein by reference in their entireties.

BACKGROUND OF THE INVENTION

The present invention relates generally to the field of hard hats. The present invention relates specifically to a hard hat lamp attachment system. Hard hats are often used in poorly illuminated areas. Hard hat use in high-risk environments for head injury may provide added protection. A lamp or flashlight may assist with vision in poorly lit or low visibility environments.

SUMMARY OF THE INVENTION

One embodiment of the invention relates to a hard hat lighting system. The hard hat lighting system includes a lamp, a hard hat, and a mounting bracket. The hard hat has a mounting ridge with opposite edges and located on a side of the hard hat. The mounting bracket securely and removably mounts on the mounting ridge of the hard hat and removably couples to the lamp. The mounting bracket includes receiving slots and a flexible strap. The receiving slots engage to opposing edges of the mounting ridge to couple the mounting bracket to the mounting ridge. The mounting bracket is removably coupled to the flexible strap and the lamp.

Another embodiment of the invention relates to a rigid mounting bracket. The rigid mounting bracket has first and second ends opposite one another. The rigid mounting bracket includes a pair of receiving slots, a flexible strap, and a pair of opposing channels. The receiving slots have a first receiving slot at the first end and a second receiving slot at the second end. The flexible strap passes through the pair of opposing channels. The first channel is on the first end and a second channel is on the second end.

Another embodiment of the invention relates to a lighting system for a hard hat. The hard hat system includes a lamp, a hard hat, and a rigid mounting bracket. The hard hat has front and rear mounting ridges on the front and rear side surfaces. The rigid mounting bracket is coupled to the lamp and interchangeably mounts to either the front or rear mounting ridge of the hard hat. The rigid mounting bracket includes receiving slots, a flexible strap, a channel, and a clip. The slots receive the mounting ridge to removably couple the rigid mounting bracket to either the front or rear side surface of the hard hat. The flexible strap removably couples the lamp to the rigid mounting bracket. The flexible strap is removably coupled to the rigid mounting bracket. The channel extends through the rigid mounting bracket to receive the flexible strap. The clip locks into a recess of the mounting ridge to secure the rigid mounting bracket and the lamp on either the front or rear mounting ridges of the hard hat.

Another embodiment of the invention relates to a lighted hard hat system. The hard hat includes a mounting ridge. The system includes a rigid mounting bracket. The rigid mounting bracket is configured to be securely and removably coupled to the mounting ridge of the hard hat. The rigid mounting bracket has receiving slots to receive the ridge of the mounting ridge and secure the rigid mounting bracket to the hard hat. The system includes a flexible strap or web that connects a lamp to the rigid mounting bracket and interconnects the lamp to the hard hat. The lamp is coupled to the strap, and the strap is coupled to the mounting bracket. The lamp is then secured to the hard hat via the coupling between the mounting bracket and the hard hat.

In various embodiments, the hard hat includes first and second mounting ridges. The first mounting ridge is located along a front surface of the hard hat, and the second mounting ridge is located along a rear surface of the hard hat. This allows a user to attach lamps to both the front and rear of the hard hat.

Another embodiment of the invention relates to a clip on the rigid mounting bracket that secures the receiving slots of the rigid mounting bracket onto the mounting ridge. The clip allows locking the lamp onto the hard hat to prevent accidental shifting or jarring of the headlamp while in operation. The operator can easily remove the rigid mounting bracket by depressing the clip and sliding the receiving slots of the bracket off the mounting ridge.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a hard hat lamp attachment system are shown. Hard hats are used in a variety of construction jobs or other construction, residential, or commercial situations. Hard hats are often used in dim or poorly lit environments. In conventional lamp attachment systems, an operator couples a lamp to hard hat via a strap wrapped around the hardhat. However, the strapped lamp often experiences jarring, which may cause the lamp to become unsecured and/or fall off. To avoid this, some operators mount the lamp onto a mounting clip that is secured to the hardhat through destructive means, such as drilling a hole in the hard hat and bolting on the mounting clip. The lamp is then attached to the mounted clip. Adding a rigid mounting location in this way compromises the safety rating and/or warranty of the hard hat.

In contrast, the hard hat system discussed herein utilizes a mounting ridge, rigid clip, and strap arrangement that allows for secure attachment of a lamp to a hard hat without end-user alteration of the hard hat structure. Specifically, the lighted hard hat system discussed herein utilizes one or more mounting ridges formed on the outer surface of the hard hat. A rigid mounting bracket is securely, and removably mounted to the mounting ridge. A flexible strap or web is coupled to the mounting bracket, and the lamp is coupled the strap. In this manner, the lamp is attached to the hard hat in manner that is more secure than the typical wrapped strap arrangement and avoids the potential problems associated with mounting systems that involve permanent alteration of the hard hat structure to attach the lamp.

In addition, because some users wear hard hats backwards (e.g., so the bill of the hard hat does not interfere with visibility), mounting locations may be added on the front and the back of the hard hat. In this embodiment, a user can wear a white-light lamp on the front of the hard hat, for example, and a red-light lamp on the back of the hard hat. This configuration enhances visibility and safety when worn in an area near heavy operating equipment (e.g., a forklift, bulldozer, boom, or other heavy operating equipment). As described below, an operator can mount two white and/or red lamps to the front and/or the rear mounting locations of the hard hat.

Figure 1:
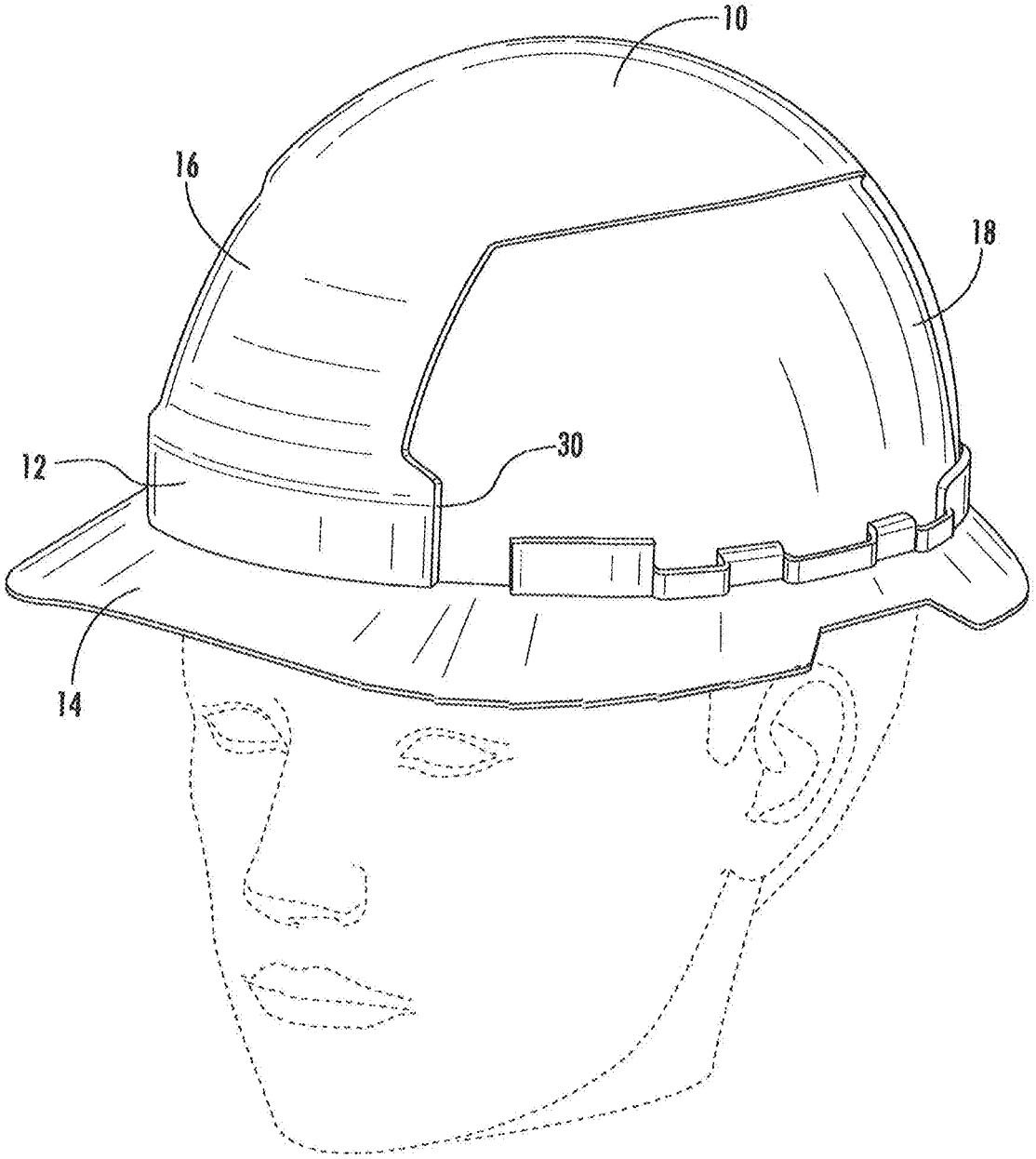
FIG. 1 illustrates a hard hat with a forward lamp mounting location worn with the brim facing forward, according to an exemplary embodiment.
Figure 2:
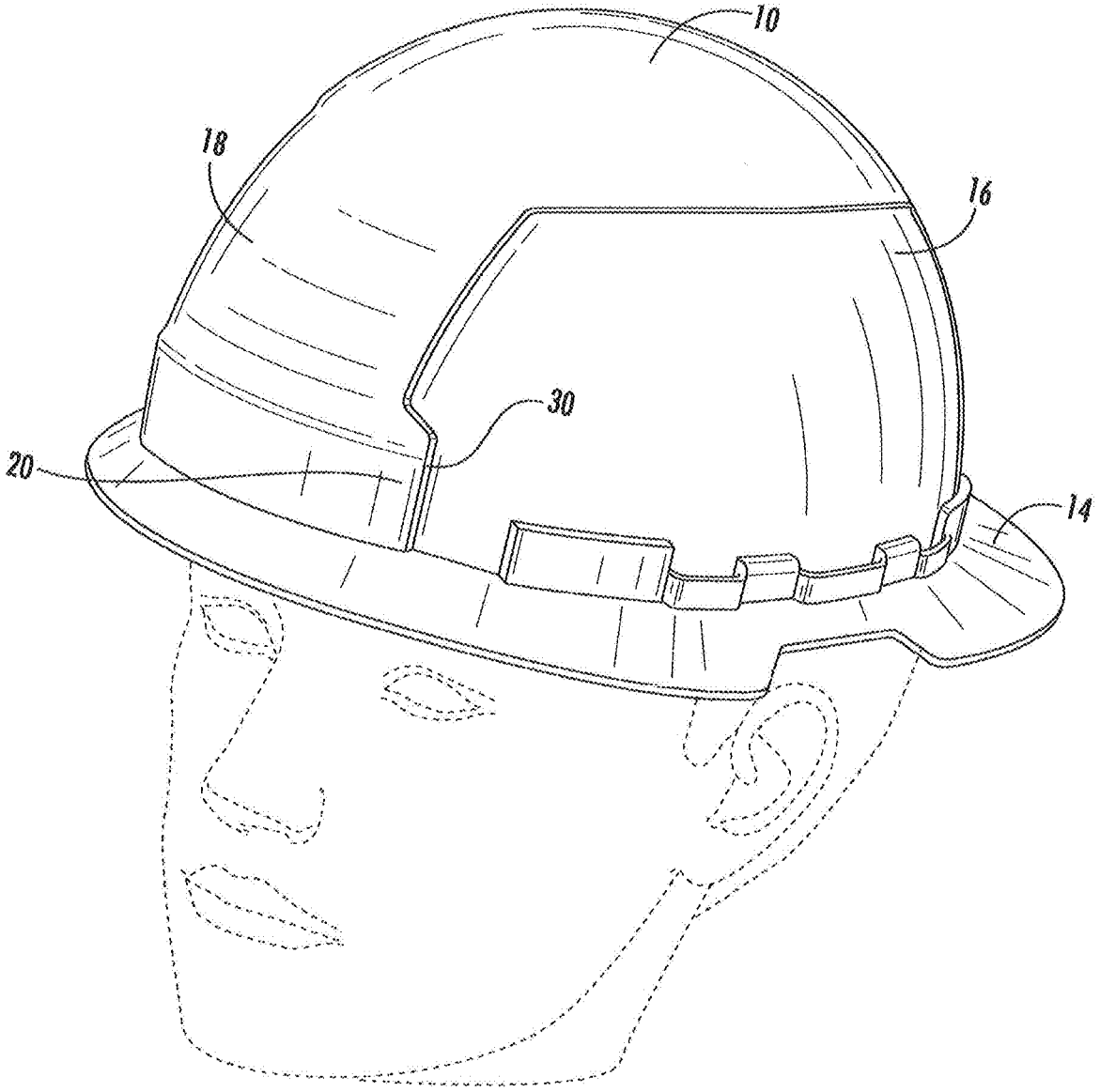
FIG. 2 illustrates a hard hat with a rearward lamp mounting location worn with the brim facing backward, according to an exemplary embodiment.

Referring generally to the figures, a lighted hard hat system is shown to for a hard hat 10. Referring to FIG. 1, an operator is shown wearing hard hat 10. As illustrated, hard hat 10 is oriented in a forward-facing direction with a front mounting ridge 12 above a bill 14 of the front end 16 of hard hat 10. In this configuration, bill 14 is on front end 16 of hard hat 10 to shields the eyes of the operator. The back end 18 is located in the back of the head/hart hat 10. For example, a front side surface on front end 16 includes a front mounting ridge 12. Similarly, a rear side surface on back end 18 includes a rear mounting ridge 20. Referring to FIG. 2, the operator can reverse hard hat 10 such that front end 16 is on the back of the head and back end 18 is above the eyes of the operator. In this orientation, rear mounting ridge 20 is located above the eyes of the user for attachment of a lamp to hard hat 10. In both FIGS. 1 and 2 a headlamp (e.g., lamp 22) can attach to a rigid mounting bracket 24 (FIG. 3) that securely attaches to hard hat 10 at a front or rear mounting ridge 12 or 20. Accessories couple to a side accessory support ridge or auxiliary ridge 21. Auxiliary ridge 21 supports accessories for hard hat 10, such as ear muffs, tool or eyeglass holders, lamp supports, face shields, and/or reflectors. In this application, reference will generally be made to front mounting ridge 12, but it should be understood that the same description equally applies to auxiliary ridge 21 and/or rear mounting ridge 20.

Figure 3:
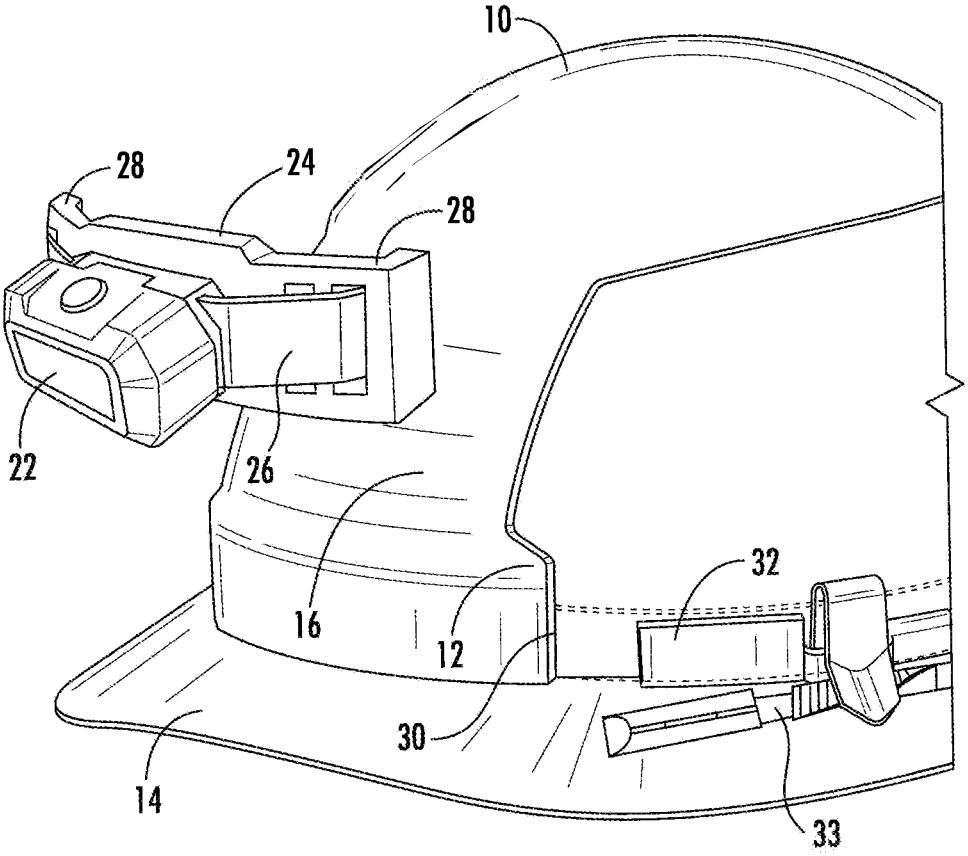
FIG. 3 is a detailed view of a disconnected lamp connected to a rigid bracket at the forward mounting location, according to an exemplary embodiment.

In general, the lighted hard hat system discussed herein includes a lamp 22, a bracket 24, and a flexible strap 26. FIG. 3 illustrates hard hat 10 of FIGS. 1 and 2 showing the attachment of lamp 22, bracket 24, and strap 26 to the mounting location on hard hat 10. Bracket 24 includes receiving slots 28 that interface with mounting ridges 12 or 20 of hard hat 10. In some embodiments, receiving slots 28 are opposed or located on opposite ends of bracket 24. Receiving slots 28 receive or couple to a ridge or outside edge 30 of mounting ridge 20 on hard hat 10. Receiving slots 28 on bracket 24 partially or completely enclose edge 30 to securely and removably couple rigid mounting bracket 24 to mounting ridge 20 and hard hat 10. Receiving slots 28 of bracket 24 interchangably couple both front and rear mounting ridges 12 and 20.

Bracket 24 provides structural support to lamp 22 and provides a rigid attachment location/support to secure lamp 22 to hard hat 10. Rigid mounting bracket 24 includes receiving slots 28 that interface with front mounting ridge 12 or rear mounting ridge 20 of hard hat 10. Strap 26 interconnects lamp 22 to bracket 24 and provides a mechanism to attach a variety of lamps 22, including aftermarket lamps 22 with strap 26 receiving locations. An auxiliary band 32 wraps around the circumference of hard hat 10 without interfering with mounting ridge 12, for example, by passing through an opening under mounting ridge 12. Auxiliary band 32 supports connection of hand tools 33 and/or other equipment suitable for storage along mounting ridge 12 of hard hat 10. In some embodiments, lamp 22 is located between opposing channels 34 on opposite ends of mounting bracket 24, e.g., a first channel 34 on a first end and a second channel 34 on a second end.

Figure 4:
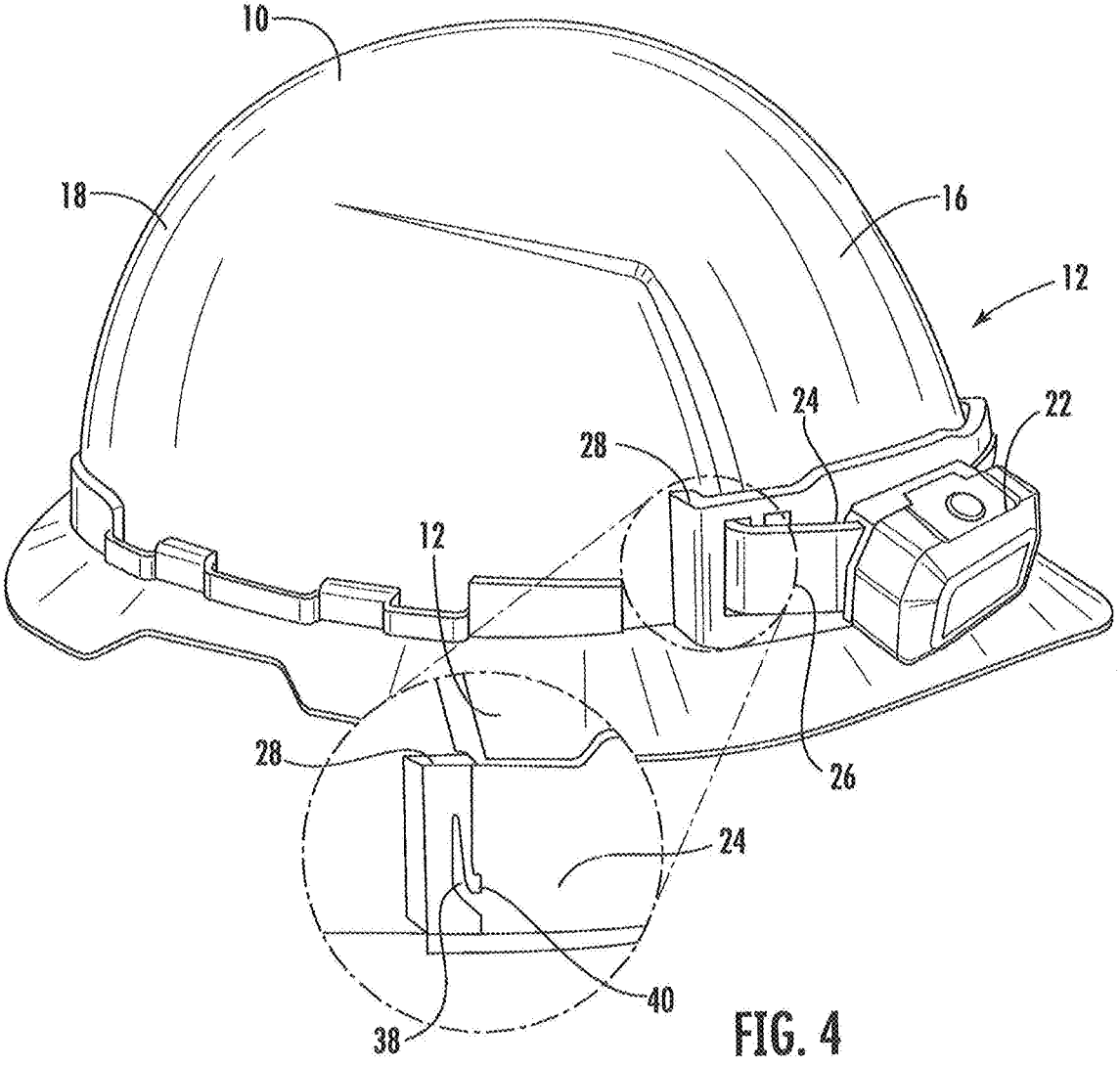
FIG. 4 illustrates the connection of the rigid bracket supporting the lamp in FIG. 3 to the forward mounting location of the hard hat, according to an exemplary embodiment.

With reference to FIG. 4, hard hat 10 with a rigid mounting bracket 24 is shown attached at front mounting ridge 12. As illustrated, rigid mounting bracket 24 is attached to a front end 16 above bill 14 of hard hat 10. Rigid mounting bracket 24 slides onto front mounting ridge 12 (or rear mounting ridge 20) via receiving slots 28. Strap 26 couples lamp 22 to rigid mounting bracket 24. For example, strap 26 can pass through channels 34 in rigid mounting bracket 24 adjacent to and/or passageways 36 in lamp 22 (FIG. 8) to couple lamp 22 to rigid mounting bracket 24 via strap 26.

FIG. 4 illustrates a side perspective view of hard hat 10 with bracket 24 attached at front mounting ridge 12. As shown, rigid mounting bracket 24 is attached to front end 16 above bill 14 of hard hat 10. Bracket 24 slides onto mounting ridge 12 (or 20) via receiving slots 28. Strap 26 passes through channels 34 to couple lamp 22 to bracket 24. For example, strap 26 passes through channels 34 in bracket 24 and/or passageways 36 in lamp 22 (FIG. 8) to couple lamp 22 to bracket 24 via strap 26. In some embodiments, strap 26 secures lamp 22 against bracket 24 on the opposite side, such that lamp 22 and strap 26 sandwich bracket 24. For example, bracket 24 is located between lamp 22 and strap 26, where lamp 22 is located on one side of bracket 24 and strap 26 is located on another or opposite side of bracket 24.

In the detailed view of FIG. 4, a securing mechanism, tab, or clip 38 is shown on one the sides of bracket 24 near receiving slots 28. When bracket 24 is secured on mounting ridge 12 or 20, clip 38 is located on the side of receiving slot 28, where clip 38 locks into position. The locked clip 38 prevents accidental jarring or removal of lamp 22 during operation. In this configuration, lamp 22 is securely locked onto hard hat 10. The operator may remove lamp 22 from hard hat 10 non-destructively by depressing clip 38 and sliding bracket 24 off mounting ridge 12 or 20. In some embodiments, clip 38 locks into a recess 40 of mounting ridge 12 and locks mounting bracket 24 on mounting ridge 12 of hard hat 10. In some embodiments, clip 38 configured to slide and/or lock into recess 40 of edge 30 to lock/secure mounting bracket 24 and lamp 22 on mounting ridge 12 of hard hat 10.

In this way, mounting ridge 12 of hard hat 10 is configured to receive a variety of headlamp sizes and designs. In the present application, two headlamp designs are shown, but any headlamp that can receive a strap 26 can be implemented to secure lamp 22 to bracket 24, as described in the present design. Thus, hard hat 10 design is backward compatible with nearly all existing headlamp designs. As such, bracket 24 can interconnect a wide variety of headlamp designs to mounting ridges 12 and/or 20 of hard hat 10.

Figure 5:
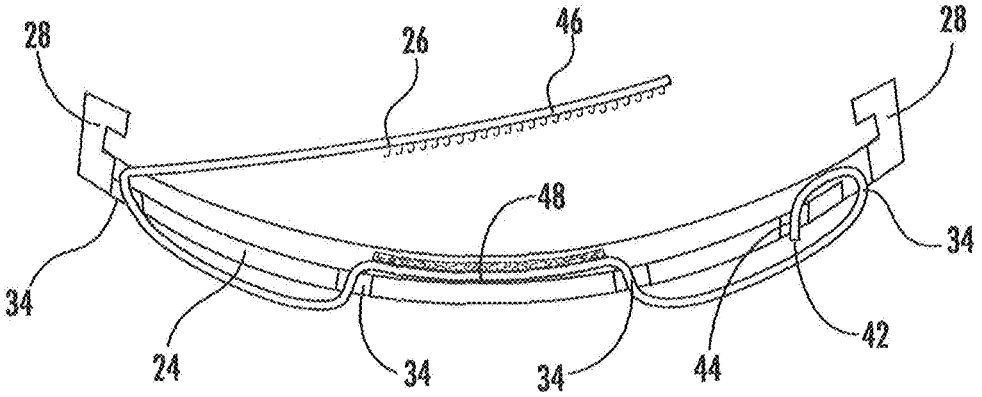
FIG. 5 is a schematic view of the strap connecting to the rigid mounting bracket with the lamp removed, according to an exemplary embodiment.

FIG. 5 is a schematic of strap 26 connecting to bracket 24 with lamp 22 removed for clarity. A hook and loop fastener system allows strap 26 to connect with itself on the backside of bracket 24. For example, strap 26 includes an endcap 42 at one end. Strap 26 is then inserted into bracket 24 at an inlet channel or insert 44. Strap 26 passes through bracket 24 until endcap 42 abuts insert 44. In various embodiments, endcap 42 is a separate part and/or includes additional materials to increase a size or dimension of endcap 42 (e.g., strap 26 is doubled back on itself, or extra adhesive is located at the end of strap 26, etc.). The enlarged size of endcap 42 prevents endcap 42 from passing through a relatively smaller cross-section of insert 44 that accommodates the dimensions of strap 26. This smaller dimension captures endcap 42 at insert 44 of mounting bracket 24, which holds or restrains strap 26 within mounting bracket 24. At least one dimension of endcap 42 is larger than insert 44 through bracket 24. In this way, when strap 26 is pulled through insert 44, endcap 42 is too large to pass and catches against insert 44.

Strap 26 wraps around all or part of bracket 24. For example, strap 26 may start at a first insert 44 and wrap around a part of rigid mounting bracket 24. Strap 26 can pass through one or more channels 34 on bracket 24. Channels 34 provide a mechanism to couple and/or tighten strap 26 to bracket 24. Receiving slots 28 securely mount bracket 24 onto mounting ridge 12 or 20 of hard hat 10. For example, receiving slots 28 of bracket 24 interchangeably couple to both front mounting ridge 12 and/or rear mounting ridge 20. In other words, bracket 24 can be placed on either the front or rear mounting ridge 12 or 18 of hard hat 10. In some embodiments, strap 26 has interlocking hook and loop fastener locations 46 and 48. Hook and loop fastener locations 46 and 48 couple to allow strap 26 to interlock with itself as the mating hook fastener section interacts with the mating loop fastener section at fastener locations 46 and 36.

FIG. 5 shows a hook fastener location 46 and a loop fastener location 48. In some embodiments, the positions of hook and fastener locations 46 and 48 are reversed, such that hook fastener location 46 is threaded through bracket 24, and the loop fastener location 48 is a free end of strap 26. In some embodiments, hook fastener location 46 is located on one end of strap 26, and loop fastener location 48 is on an opposite end of strap 26. Hook and loop fastener locations 46 and 48 couple to removably secure strap 26 on bracket 24. Hook and loop fasteners couple to removably secure strap 26 to bracket 24 and include other interlocking systems such as hook and loop fabric, snaps, pins, tape, and/or glue.

Figure 6:
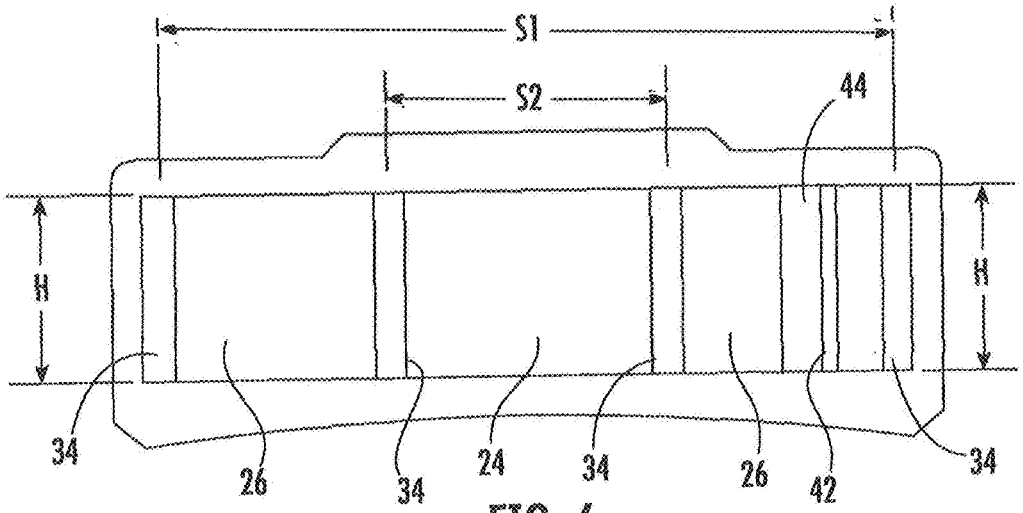
FIG. 6 is a front view of the strap and rigid bracket, illustrating some exemplary dimensions of a strap and bracket configuration, according to an exemplary embodiment.

FIG. 6 is a front view of bracket 24 with both strap 26 and lamp 22 removed to show some dimensions for channels 34 and/or locations between channels 34. In the illustrated embodiment, channel 34 receives strap 26 and has a height, H, of about 26 mm. Two outermost channels 34 (e.g., opposing channels 34 located on the outside of either end of bracket 24) have a spacing S1 of 102 mm, with adjacent medial slots or channels 34 having a spacing S2 of 32 mm apart. Medial channels 34 are located between the ends of the outermost channels 34. In various embodiments, channel 34 that receives strap 26 has a height, H, of between 10 mm and 50 mm, specifically between 15 mm and 35 mm, and more specifically between 20 mm and 30 mm. Outermost channels 34 have a spacing S1, which is between 50 mm and 150 mm, specifically 75 mm to 125 mm, and more specifically 90 mm to 110 mm. In various embodiments, adjacent medial slots have a spacing S2 of 15 mm to 45 mm, specifically 20 mm to 40 mm, and more specifically 25 mm to 35 mm. For example, the distance S2 between two medial channels 34 is about 38 mm. In other embodiments, distance S2 of two medial channels 34 is between 25 mm and 55 mm, specifically 30 mm and 50 mm, and more specifically between 35 mm and 45 mm.

In some embodiments, insert 44 is located between a first medial channel 34 and a first outermost channel 34. That is, the first medial channel 34, insert 44, and first outermost channel 34 are located on the first side of bracket 24. Insert 44 has at least one dimension that is smaller than endcap 42 of an end of strap 26 to restrain and/or capture through bracket 24. In this way, insert 44 is disposed on one side of bracket 24 between the medial and outermost channels 34.

Figure 7:
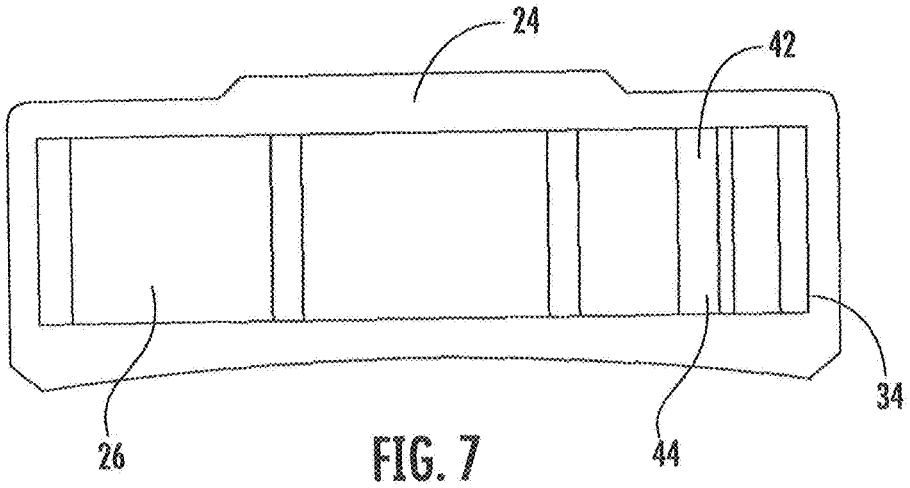
FIG. 7 is a front view of the rigid bracket and strap of FIG. 6, according to an exemplary embodiment.

FIG. 7 is a front view of one embodiment of bracket 24 with strap 26 and lamp 22 removed. The dimensions in the embodiment shown in FIG. 7 may be the same or different than the dimensions illustrated in FIG. 6. In some embodiments, the distance between bracket 24 and hard hat 10 is designed to have a gap that presses the hook and loop fastener locations 46 and 48 together on strap 26. In this way, the gap facilitates a strong interlocking connection on strap 26 and reduces the likelihood of jarring or loosening lamp 22 over time.

In some embodiments, bracket 24 provides a bias or spring force to retain bracket 24 on mounting ridge 12 on hard hat 10. Edges 30 of mounting ridge 12 (and/or 20) press against receiving slots 28 of bracket 24 to provide a securing biasing force that holds bracket 24 on mounting ridge 12. This configuration further enhances the strength of the connection and prevents accidental jarring and/or escape of lamp 22 from hard hat 10. Receiving slots 28 engage opposing outer edges 30 of mounting ridge 12 to couple bracket 24 to mounting ridge 12 and hard hat 10. In this way, bracket 24 is removably coupled to lamp 22 and strap 26.

Figure 8:
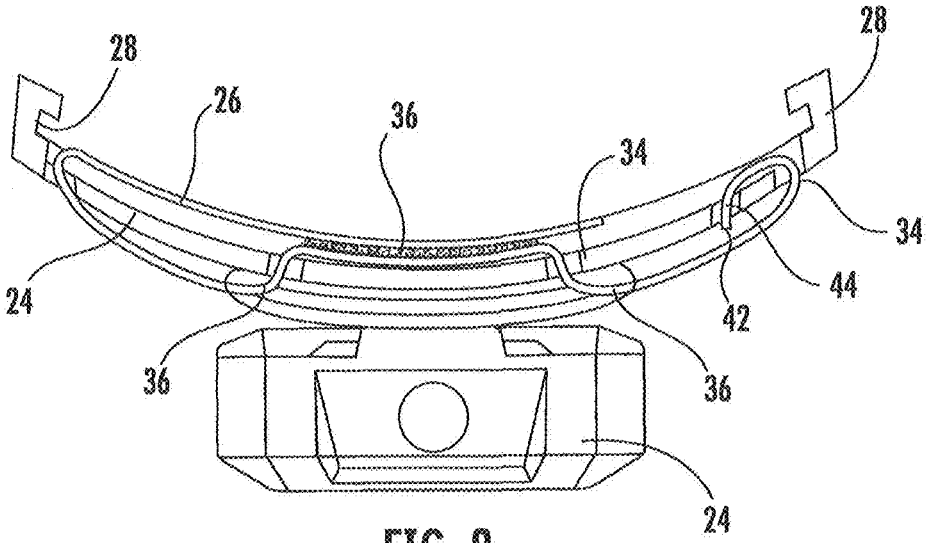
FIG. 8 is a schematic view of the strap connecting to the rigid mounting bracket with the lamp being supported by the strap and bracket, according to an exemplary embodiment.

FIG. 8 is a schematic top view of strap 26 connecting lamp 22 to bracket 24. In this embodiment, hook and loop fastener locations 46 and 48 are shown to be mating. Similar to the embodiment of FIG. 5, endcap 42 starts at insert 44 and strap 26 wraps around a part of bracket 24 and passes through several channels 34 to entwine strap 26 to bracket 24. As illustrated, strap 26 passes through channels 34 on bracket 24 and passes through the passageways 36 in lamp 22 to secure lamp 22 to bracket 24. Strap 26 then doubles back on itself at the hook and loop fastener locations 46 and 48 to secure strap 26. Channels 34 pass-through mounting bracket 24 to receive a portion of strap 26 and secure lamp 22 to mounting bracket 24.

Figure 9:
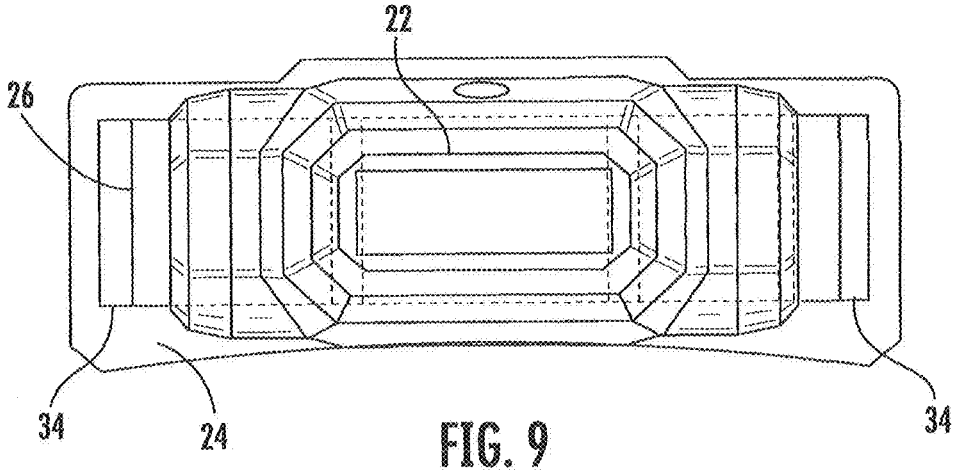
FIG. 9 is a front view of a rigid bracket and a strap supporting the lamp of FIGS. 11 and 12, according to an exemplary embodiment.
Figure 10:
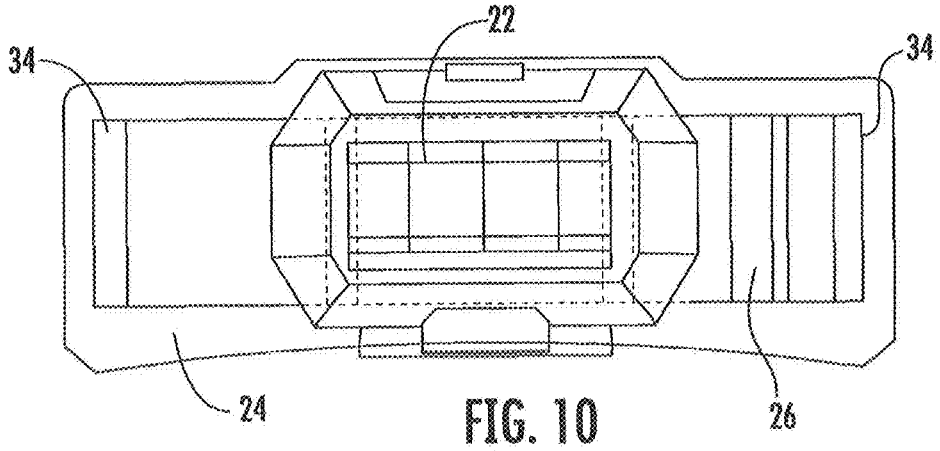
FIG. 10 is a front view of a rigid bracket and a strap supporting the lamp of FIGS. 13 and 14, according to an exemplary embodiment.
Figure 11:
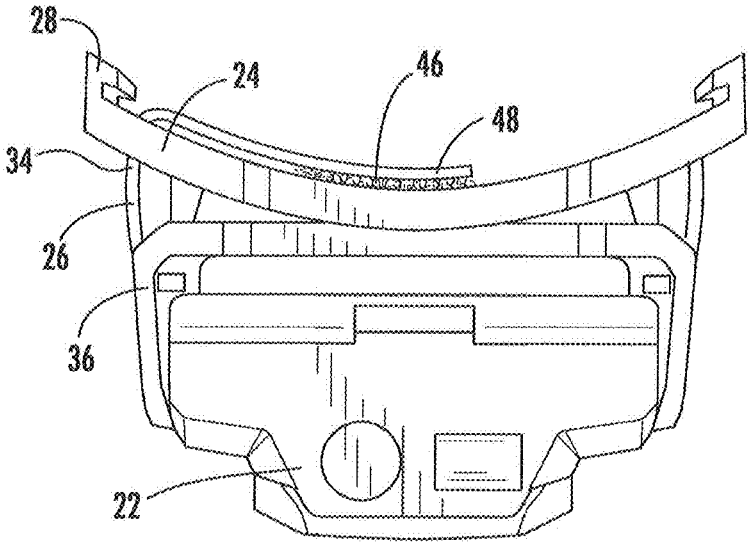
FIG. 11 is a top view of one embodiment of a lamp connected to the rigid bracket with a hook and loop fastener, according to an exemplary embodiment.
Figure 12:
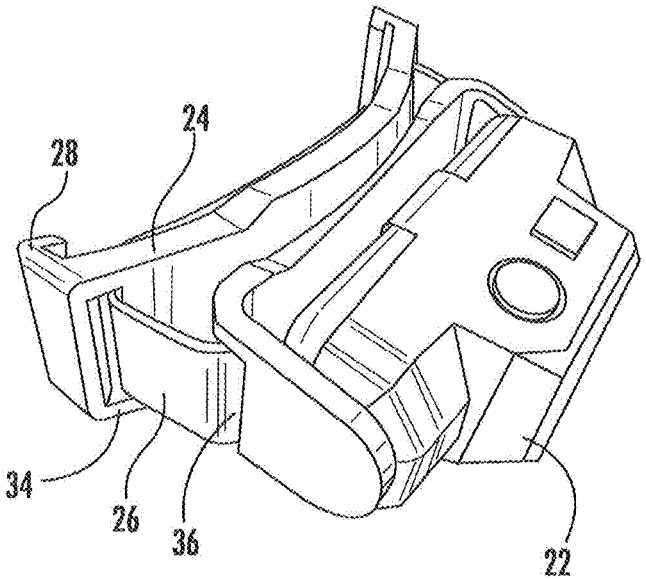
FIG. 12 is a side perspective view of one embodiment of the lamp and bracket system of FIG. 11, according to an exemplary embodiment.
Figure 13:
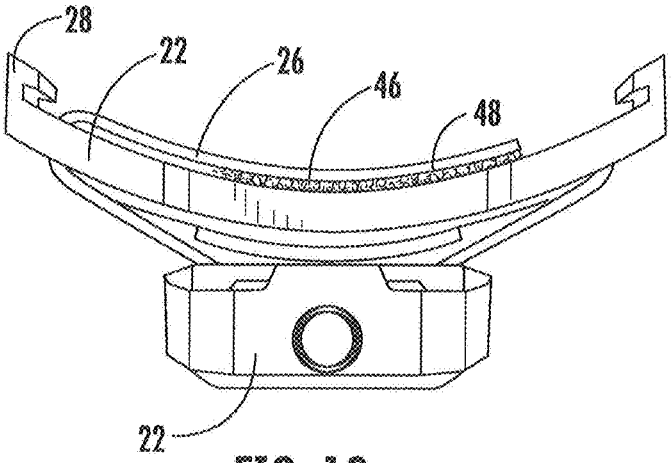
FIG. 13 is a top view of one embodiment of a lamp connected to the rigid bracket with a hook and loop fastener, according to an exemplary embodiment.
Figure 14:
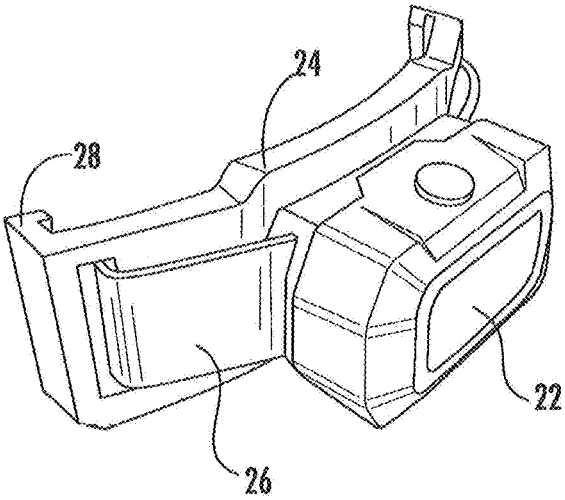
FIG. 14 is a side perspective view of one embodiment of the lamp and bracket system of FIG. 13, according to an exemplary embodiment.

FIG. 9 is a front view of a bracket 24 and a strap 26 supporting one embodiment of an example lamp 22 (e.g., lamp 22 illustrated in FIGS. 11 and 12). As illustrated, lamp 22 has structure on the sides of lamp 22 that reroute strap 26 around lamp 22. Strap 26 remains secured by the hook and loop fastener locations 46 and 48 (FIG. 5). Strap 26 secures lamp 22 to bracket 24. FIG. 10 shows a front view of rigid mounting bracket 24 and strap 26 supporting one embodiment of lamp 22 (e.g., lamp 22 as shown in FIGS. 13 and 14). Lamp 22 has fewer surrounding structures, reducing the path of strap 26 to secure lamp 22. Strap 26 passes through openings and folds back on itself at hook and fastener locations 46 and 48 (see FIG. 8).

FIGS. 11 and 12 illustrate a top view and side perspective view of the first lamp 22 embodiment of FIG. 9, respectively. Lamp 22 has a supporting structure on the sides that attach lamp 22 to other structures. However, since the structure has passageways 36 to allow strap 26 to pass through the supporting structures of lamp 22 and into adjoining channels 34, lamp 22 can securely fasten onto bracket 24. Strap 26 interconnects with itself at hook and loop fastener locations 46 and 48.

Similarly, FIGS. 13 and 14 illustrate a top and side perspective view of the second lamp embodiment of FIG. 10. Without the additional supporting structures, strap 26 passes through passageways 36 of lamp 22 to interconnect lamp 22 to bracket 24. Passageways 36 through a section of lamp 22 are used to couple lamp 22 to strap 26. In other words, passageways 36 receive strap 26 and couple lamp 22 to mounting bracket 24. As shown in FIGS. 13 and 14, this configuration supports a larger lamp 22 and sandwiches bracket 24 between lamp 22 and strap 26.

Figure 15:
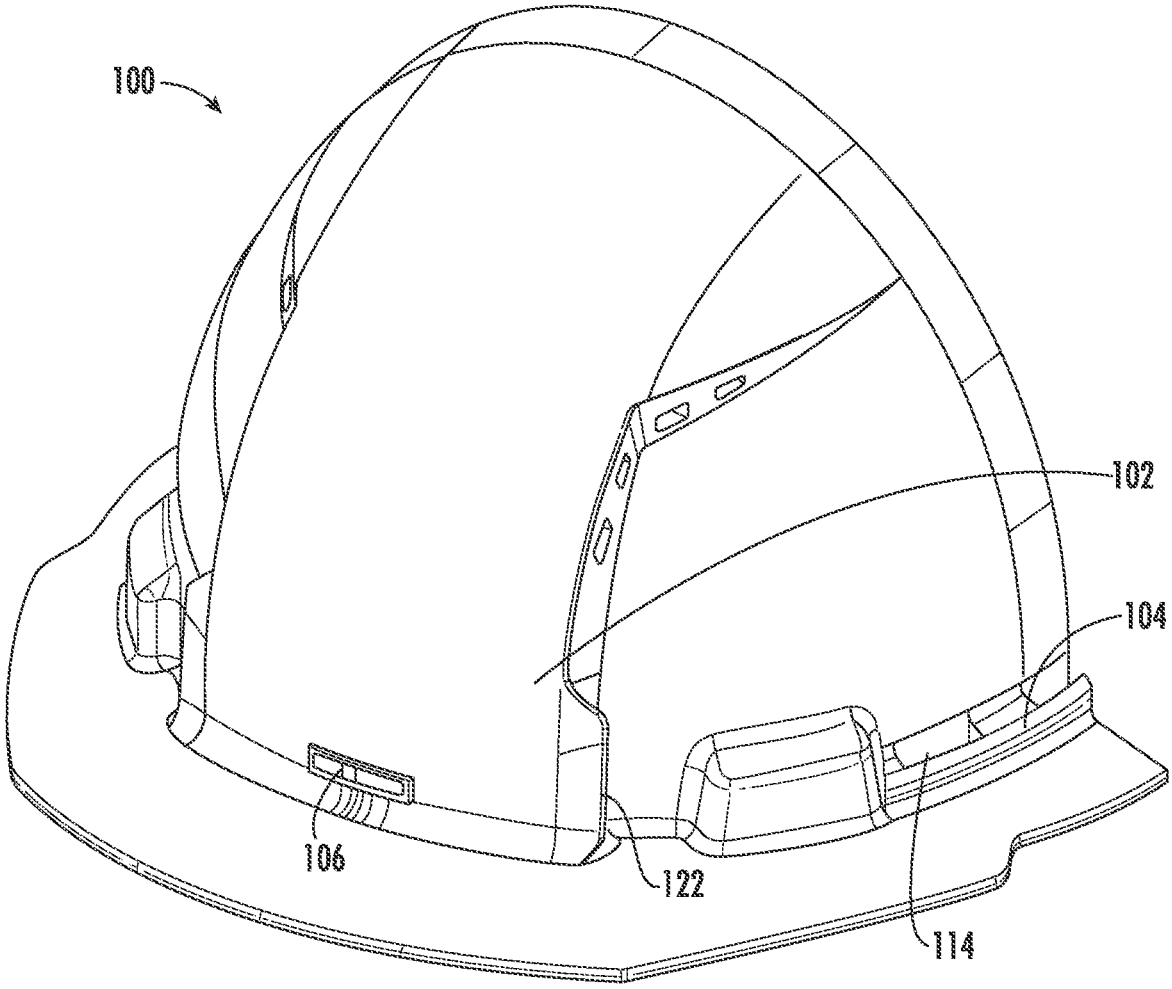
FIG. 15 is a front perspective view of a front half full brim of a hard hat, according to an exemplary embodiment.
Figure 16:
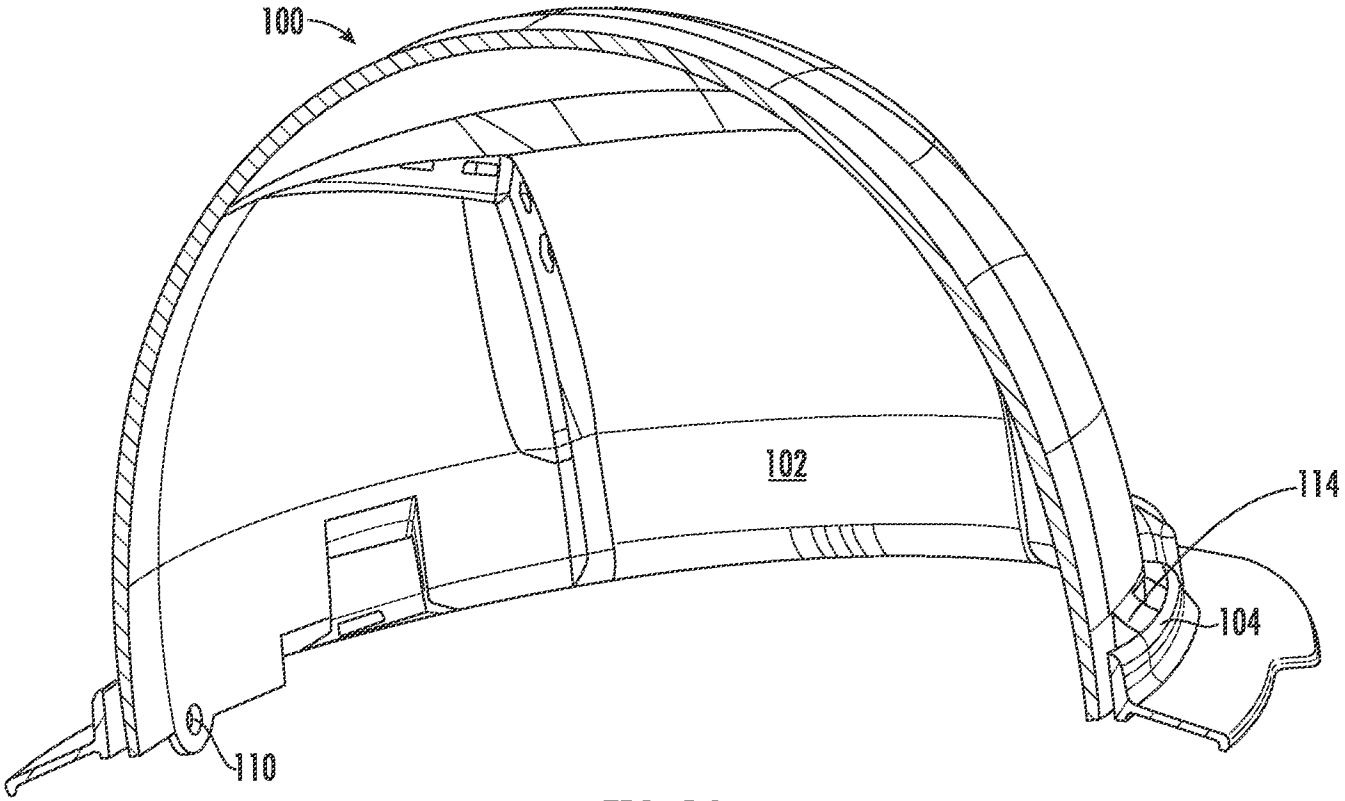
FIG. 16 is a rear perspective view of the front half full brim hard hat of FIG. 15, according to an exemplary embodiment.
Figure 17:
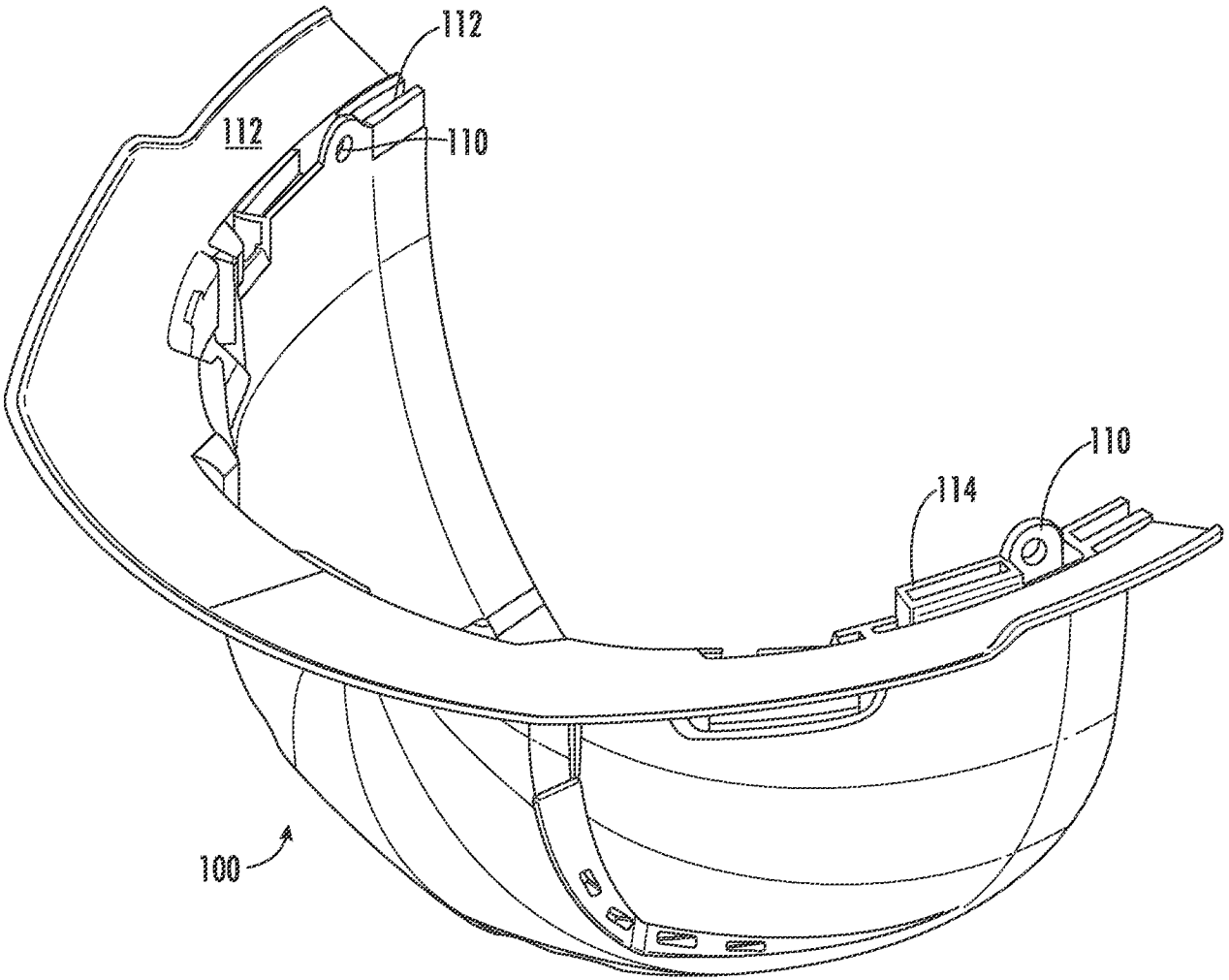
FIG. 17 is a bottom perspective view of the front half full brim hard hat of FIG. 15, according to an exemplary embodiment.

FIGS. 15-18 show different perspective views of a front half of a full brim hard hat 100. Hard hat 100 is the same as hard hat 10, except for the differences shown and/or described herein. In contrast to hard hat 10, hard hat 100 has a modified mounting ridge 102 and auxiliary ridge 104. Detent 106 secures a bracket 108 (see e.g., FIG. 18) to the mounting ridge 102. FIG. 15 shows the modified mounting ridge 102 and auxiliary ridge 104. FIG. 16 shows button holes 110 to secure a strap or other item to a base 112 (FIG. 17) of hard hat 100. FIG. 17 shows a variety of internal ridges or access ports 114 that support accessories on an inner surface of hard hat 100. Similarly, auxiliary ridges 104 include access ports 114 to couple various accessories to hard hat 100.

Figure 18:
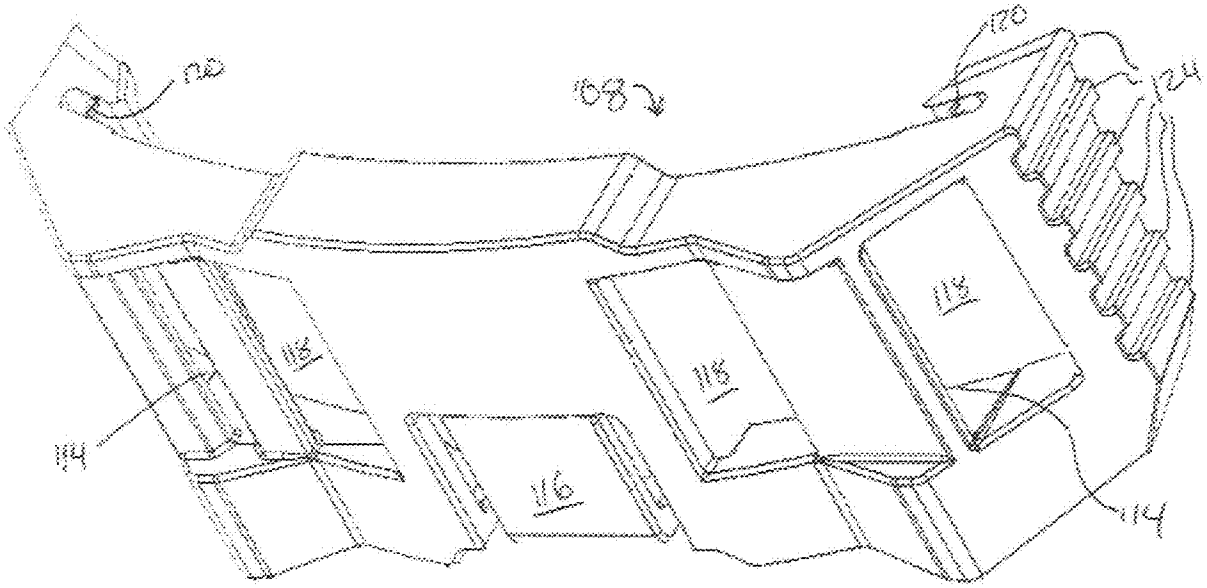
FIG. 18 is front perspective view of a bracket, according to an exemplary embodiment.

FIGS. 18-25 show a bracket 108 configured to mount and/or couple to mounting ridges 102 of hard hat 100. FIG. 18 shows a snap fastener 116 that snaps around detent 106 to secure bracket 108 on mounting ridge 102 of hard hat 100. The interaction between fastener 116 and detent 106 secures bracket 108 and prevents accidental jarring or loosening of the coupling between bracket 108 and mounting ridge 102. Openings 118 provide additional access ports 114 for fastening or coupling additional accessories to a mounted bracket 108. Slots 120 couple to an edge 122 (FIG. 15) of mounting ridges 102. Ribs 124 provide a frictional surface for removing bracket 108 from mounting ridges 102, for example, in a wet, muddy, or freezing environment. Ribs 124 provide additional surfaces for a user to press and release bracket 108 to a mounting ridge 102. Similarly, ribs 124 assist a user to securing (and/or release) bracket 108 to hard hat 100 when grip or friction is limited, for example, while the user is wearing gloves.

Figure 19:
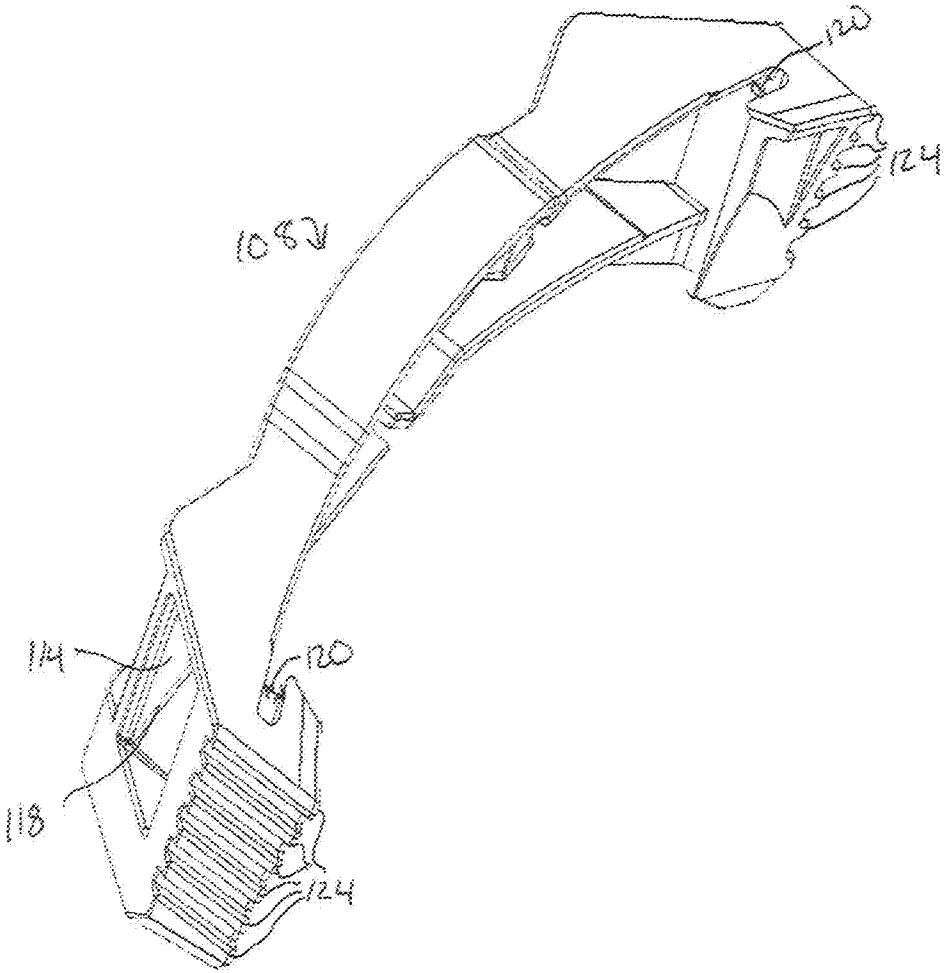
FIG. 19 is a top perspective view of the bracket of FIG. 18, according to an exemplary embodiment.
Figure 20:
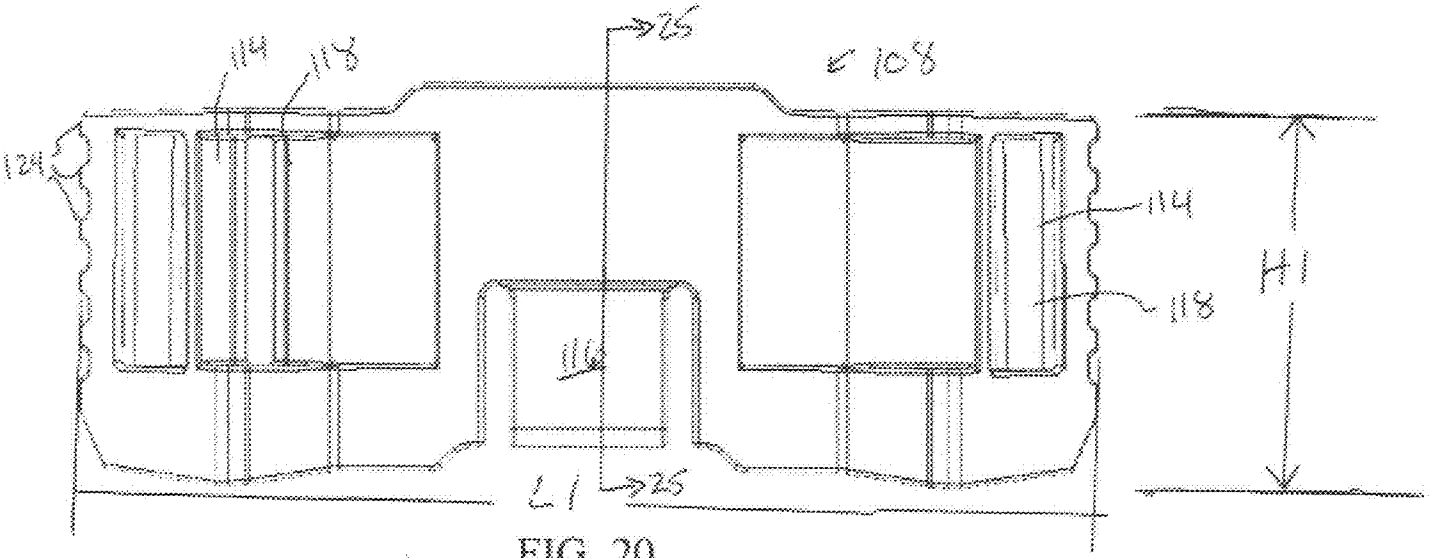
FIG. 20 is a front isometric view of the bracket of FIG. 18, according to an exemplary embodiment.
Figure 21:
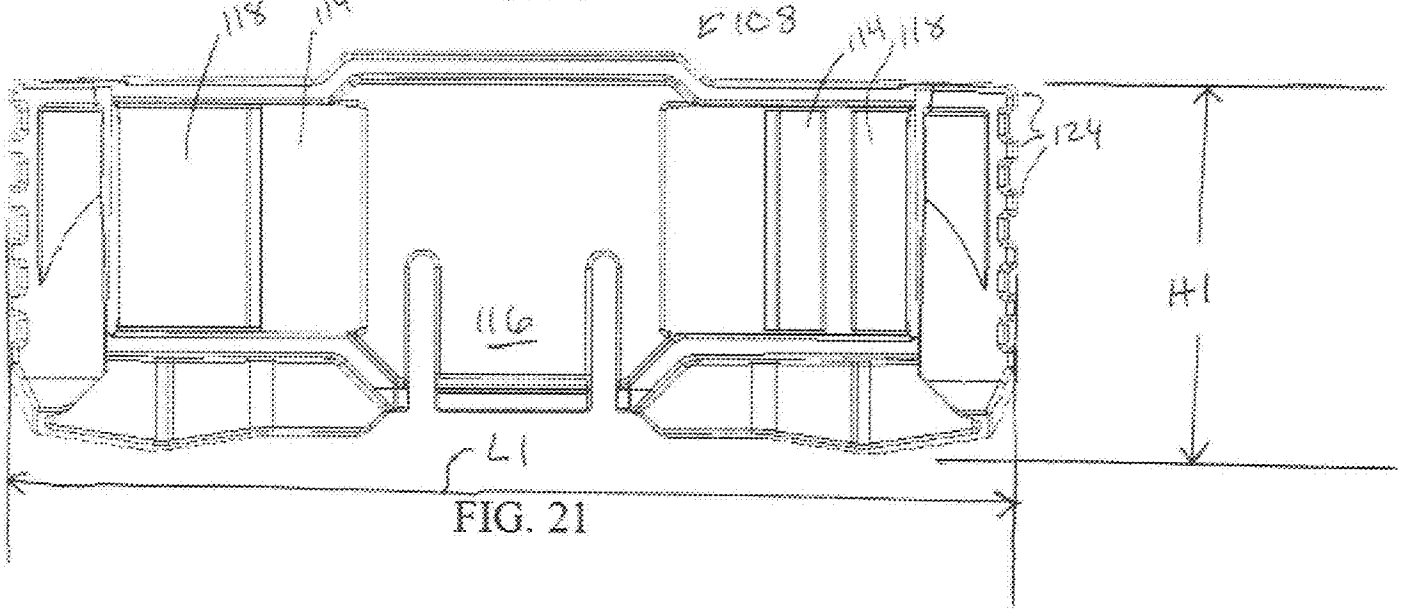
FIG. 21 is a rear isometric view of the bracket of FIG. 18, according to an exemplary embodiment.

FIG. 19 is a top perspective view of bracket 108, showing openings 118, slots 120, and ribs 124. This view shows a substantially hollow bracket 108 to reduce weight. FIGS. 20 and 21 show front and rear isometric views of bracket 108. A height H1 of bracket 108 is shown. In various embodiments, height H1 is between 1" and 2", specifically between 1.5" and 1.75", and more specifically between 1.6" and 1.7". In a specific embodiment, height H1 is about 1.62" These views show openings 118 in front and rear of bracket 108 that extend through bracket 108. Snap fastener 116 is curved at the bottom so that it extends inwardly in FIG. 21 to couple to detent 106. Ribs 124 are shown on either side of bracket 108.

FIGS. 20 and 21 show various dimensions for a length L1 of bracket 108. In various embodiments, length L1 is between 3" and 6", specifically between 4" and 5", and more specifically between 4.25" and 4.75". In a specific embodiment, length L1 is about 4.54".

Figure 22:
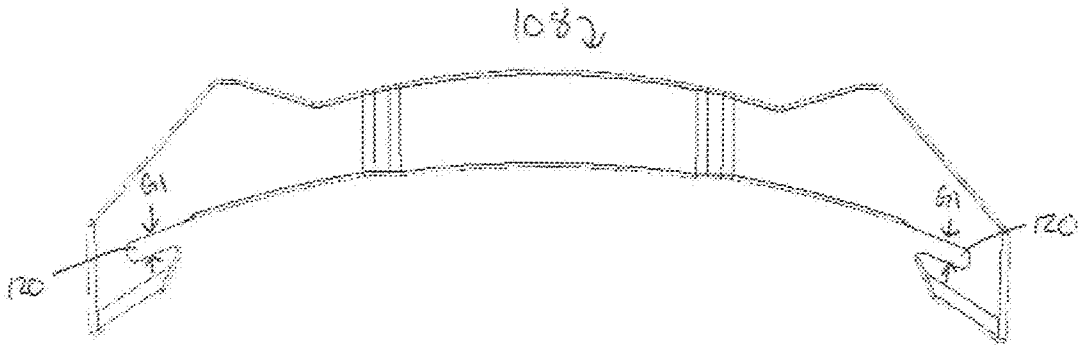
FIG. 22 is a top isometric view of the bracket of FIG. 18, according to an exemplary embodiment.
Figure 23:
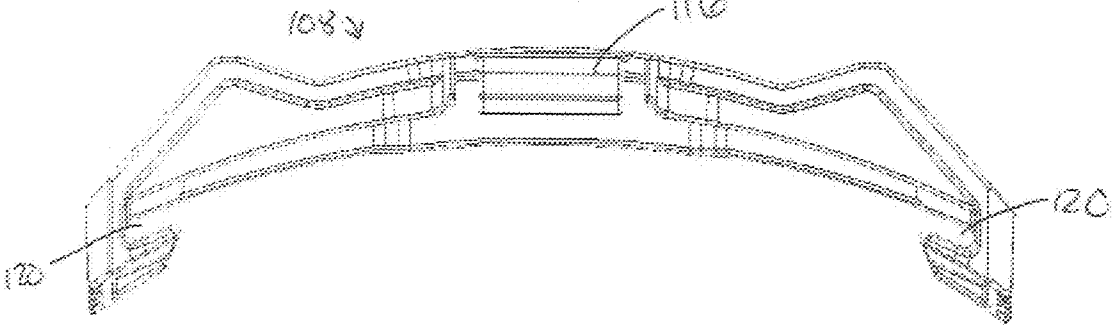
FIG. 23 is a bottom isometric view of the bracket of FIG. 18, according to an exemplary embodiment.

FIGS. 22 and 23 are top and bottom isometric views of bracket 108. A width or gap G1 of slot 120 is shown. In various embodiments, gap G1 measured in slot 120 between a front and rear edge of bracket 108 is between 0.050" and 0.150", specifically, between 0075" to 0.125" and more specifically between 0090" and 0.100". In a specific embodiment, gap G1 is about 0.092".

Figure 24:
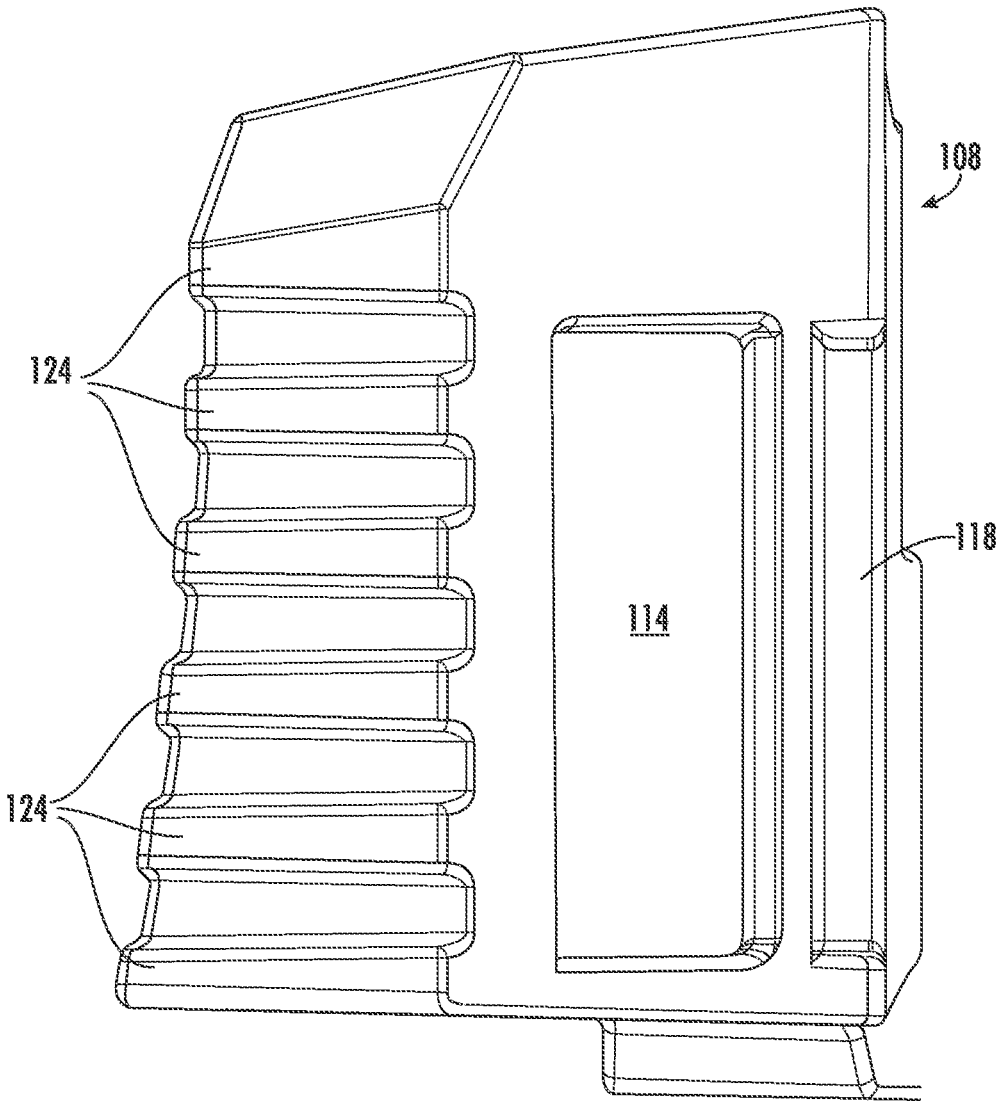
FIG. 24 is a side isometric view of the bracket of FIG. 18, according to an exemplary embodiment.
Figure 25:
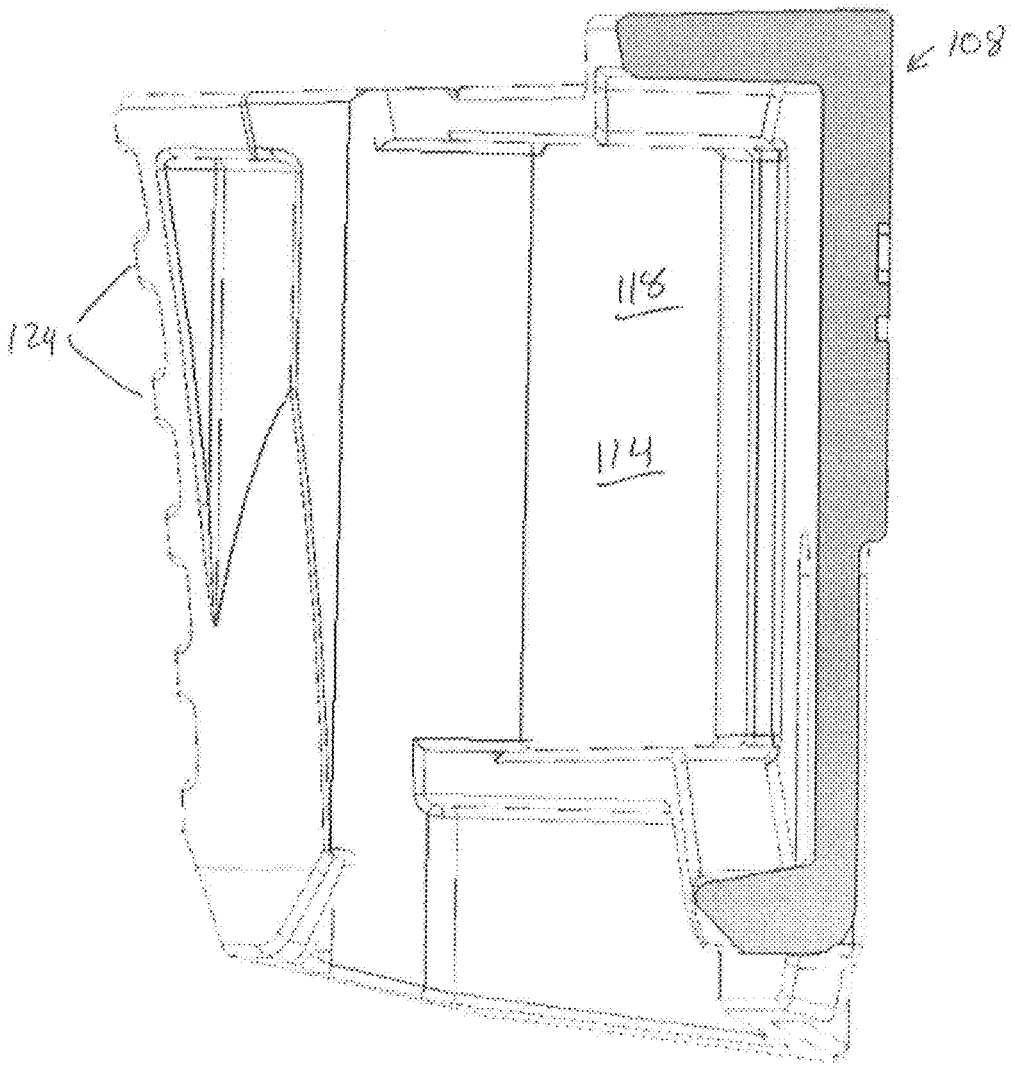
FIG. 25 is a side cross-sectional isometric view of the bracket of FIG. 18 taken along line 25-25 of FIG. 20, according to an exemplary embodiment.

FIG. 24 is a side isometric view of bracket 108 and FIG. 25 is a cross-sectional view of the side isometric view of FIG. 24 taken along line 25-25 of FIG. 20. FIGS. 24 and 25 show inside and outside view of fastener 116, openings 118, and ribs 124.

Figure 26:
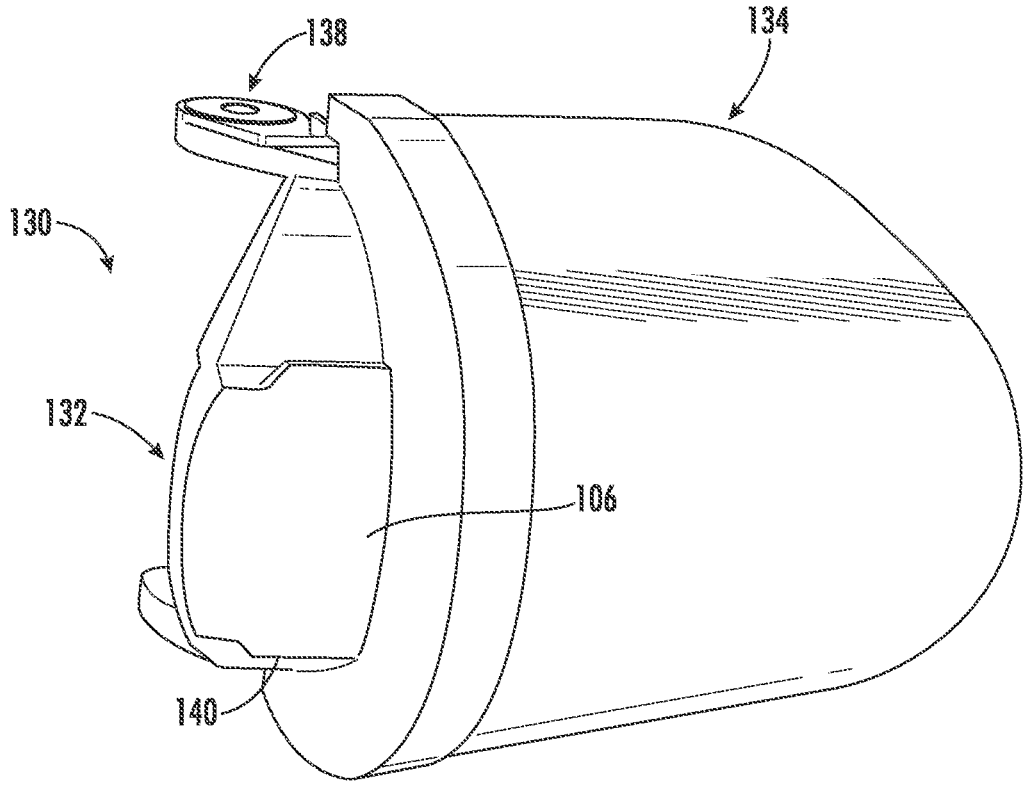
FIG. 26 is a face shield with lamp attachment mounting brackets, according to an exemplary embodiment.

FIG. 26 shows one accessory that couples to mounting ridge 102 (or mounting ridge 12), specifically a face shield 130 with an outer mounting ridge 132, the same as or similar to mounting ridge 102 or 12 on hard hat 100 or 10, respectively. In general, reference will be made to hard hat 100, but the following description also applies to hard hat 10. Mounting ridge 132 on face shield 130 receives bracket 108 to couple the accessory to hard hat 100 and/or face shield 130. In this way, the same accessories that couple to mounting ridges 102 on hard hat 100 also couple to mounting ridges 132 of a mounted face shield 130.

In some embodiments, face shield 130 includes a face mask 134 comprising a transparent glass, polyurethane, or polymer to protect a face and/or eyes of the operator from debris. In other embodiments, face mask 134 is substantially opaque, e.g., for wielding, and limits one or more wavelengths of light that pass through mask 134 to protect the operator's eyes. Face shield 130 and/or mask 134 protect the operator's face and/or eyes from debris, temperature, light, liquids, and/or chemicals. In some embodiments, face shield 130 includes an attachment clip 138 that further secures face shield 130 against hard hat 100, e.g., at accessory support or auxiliary ridge 104. For example, face shield 130 couples to bracket 108 and to mounting ridge 102. Accessory clip 138 couples to auxiliary ridge 104 of hard hat 100. Face shield 130 further comprises an outer mounting ridge 132 used to couple accessories (e.g., lamp 142). For example, a bracket 114 on face shield 130 couples to outer mounting ridge edges 140 through slots 120 of bracket 114, in a manner similar to coupling to outer mounting ridge edges 122 or 30 on hard hat 10 or 100.

FIG. 26 shows face shield 130 supporting lamp 142 on outer mounting ridge 132 of face shield 130, where face shield 130 is coupled to mounting ridges 102 on hard hat 100. Outer mounting ridge 132 on face shield 130 is the same, or substantially the same, as mounting ridge 102 on hard hat 100, such that accessories with bracket 108 couple to either mounting ridges 102 on hard hat 100 and/or outer mounting ridges 132 of face shield 130. In some embodiments, a swivel 144 is located between face shield 130 and clip 148 to facilitate the movement of face shield 130. For example, after welding a part, an operator may lift face shield 130 to temporarily look at the welded part or take a break, etc.

Figure 27:
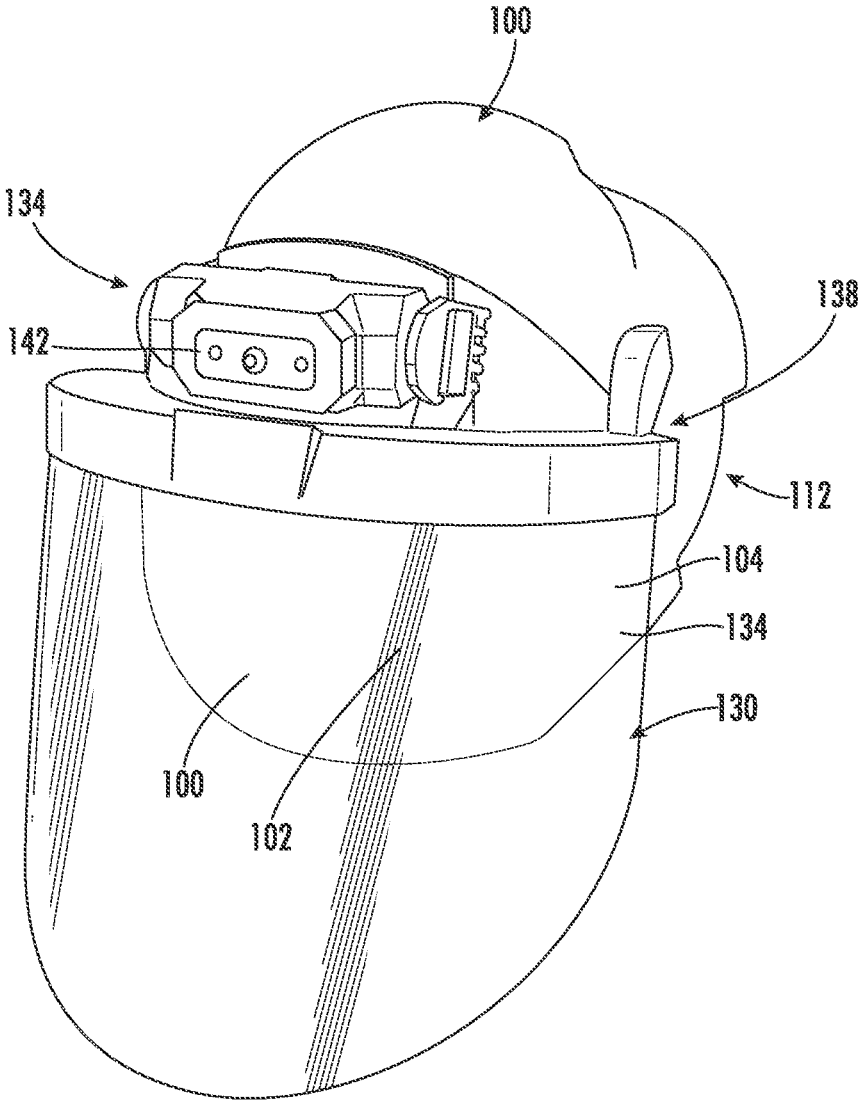
FIG. 27 is the face shield of FIG. 26 coupled to a bracket of a lamp assembly, according to an exemplary embodiment.
Figure 28:
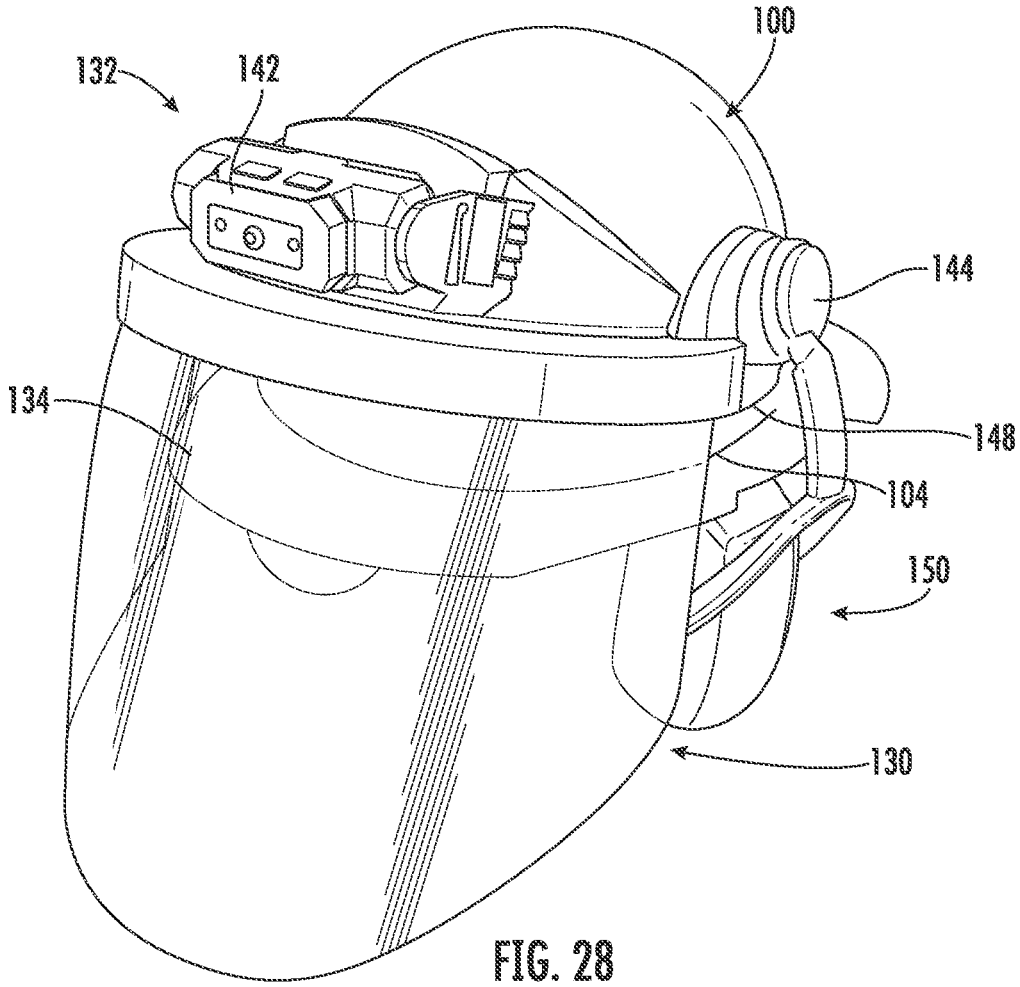
FIG. 28 is the face shield of FIG. 26 coupled to a hard hat and showing additional accessories, according to an exemplary embodiment.

FIGS. 27 and 28 show one configuration of hard hat 100, further including additional accessories coupled to mounting ridges 102 and auxiliary ridges 104 of hard hat 100. For example, earmuffs 150 are coupled to auxiliary ridges 104 and lamp 142 is coupled to outer mounting ridge 132 of face shield 130. Face shield 130 is coupled to mounting ridge 102 of hard hat 100, and earmuffs 150 are coupled to left and right auxiliary ridges 104 on opposite sides of hard hat 100. For example, auxiliary ridges 104 include ports 114 to secure portions of the accessories. Additional mounting ridges 102 and/or supporting auxiliary ridges 104 include a plurality of ports 114 to support additional accessories (e.g., reflectors, tool carriers, and/or eyeglass holders, etc.). One feature of this hard hat attachment system is the ability of a user to customize or configure a hard hat 100 for the particular job, environment, and/or safety requirements of the task.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths, and radii, as shown in the Figures are to scale. Actual measurements of the Figures will disclose relative dimensions, angles, and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

I claim:

1. A hard hat lighting system, comprising:

a lamp;

a hard hat with a mounting ridge comprising opposite edges, the mounting ridge located on a side of the hard hat;

a mounting bracket that securely and removably mounts to the mounting ridge of the hard hat, the mounting bracket removably coupled to the lamp, the mounting bracket comprising:

receiving slots engaged to opposing edges of the mounting ridge to couple the mounting bracket to the mounting ridge; and a flexible strap that couples the lamp to the mounting bracket, the lamp being removably coupled from the flexible strap and the flexible strap being removably coupled to the mounting bracket.

2. The hard hat system of claim 1, wherein the hard hat comprises a front mounting ridge and a rear mounting ridge, and wherein the receiving slots interchangeably couple to both the front mounting ridge and the rear mounting ridge.

3. The hard hat system of claim 1, further comprising a hook fastener location on one end of the flexible strap and a loop fastener location on an opposite end of the flexible strap, the hook and loop fastener locations couple to removably secure the flexible strap on the mounting bracket.

4. The hard hat system of claim 1, further comprising an endcap at one end of the flexible strap, wherein the endcap is captured at an insert of the mounting bracket and couples the flexible strap within the mounting bracket.

5. The hard hat system of claim 1, further comprising passageways through a section of the lamp that receives the flexible strap to couple the lamp to the mounting bracket.

6. The hard hat system of claim 1, further comprising a channel through the mounting bracket, wherein a portion of the flexible strap passes through the channel to secure the lamp to the mounting bracket.

7. The hard hat system of claim 1, further comprising a clip that locks into a recess of the mounting ridge to lock the mounting bracket on the mounting ridge of the hard hat.

8. A rigid mounting bracket with a first end and a second end opposite the first end, the rigid mounting bracket comprising:

a pair of opposing receiving slots, wherein a first receiving slot is on the first end and a second receiving slot is on the second end;

a flexible strap; and a pair of opposing channels, wherein a first channel is on the first end and a second channel is on the second end, the flexible strap passing through the first and second channel;

wherein the opposing receiving slots receive a ridge of a hard hat, and the receiving slots partially enclose the ridge and couple the rigid mounting bracket on the hard hat.

9. The rigid mounting bracket of claim 8, further comprising a clip on a side of the first receiving slot, the clip configured to slide into a recess of a ridge on a hard hat and lock the mounting bracket and lamp on the ridge.

10. The rigid mounting bracket of claim 8, wherein a lamp is located between the first channel on the first end and the second channel on the second end.

11. The rigid mounting bracket of claim 10, wherein the flexible strap secures the lamp against the rigid mounting bracket, wherein the rigid mounting bracket is between the flexible strap and the lamp, the lamp being located on one side and the flexible strap being located on another opposite side of the rigid mounting bracket.

12. The rigid mounting bracket of claim 8, further comprising a hook fastener location and a loop fastener location on the flexible strap, the hook fastener location, and the loop fastener location couple and removably secure the flexible strap on the mounting bracket.

13. The rigid mounting bracket of claim 12, further comprising an endcap at one end of the flexible strap, the endcap having a dimension that is larger than an insert through the rigid mounting bracket, wherein the endcap of the flexible strap is coupled to the insert to capture the flexible strap at the insert.

14. A hard hat lighting system, comprising:

a lamp;

a hard hat with a front mounting ridge on a front side surface and a rear mounting ridge on a rear side surface;

a rigid mounting bracket that securely and removably mounts to either the front mounting ridge or the rear mounting ridge of the hard hat, the rigid mounting bracket removably coupled to the lamp, the rigid mounting bracket comprising:

receiving slots that receive the mounting ridge and removably couple the rigid mounting bracket to one of the front side surface or the rear side surface of the hard hat;

a flexible strap that couples the lamp to the rigid mounting bracket, the lamp being removably coupled from the flexible strap and the flexible strap being removably coupled to the rigid mounting bracket;

a channel extending through the rigid mounting bracket that receives the flexible strap;

a clip that locks into a recess of the mounting ridge to lock the rigid mounting bracket and the lamp on one of the front or rear mounting ridges of the hard hat.

15. The hard hat lighting system of claim 14, wherein the rigid mounting bracket is biased, wherein edges of the front or rear mounting ridge press against the receiving slots of the rigid mounting bracket to provide a securing biasing force when the rigid mounting is secured to the hard hat.

16. The hard hat lighting system of claim 14, wherein the channel has a height between 10 mm and 50 mm.

17. The hard hat lighting system of claim 14, further comprising two outermost channels on either end of the rigid mounting bracket and extending through the rigid mounting bracket and two medial channels located between the two outermost channels and extending through the rigid mounting bracket.

18. The hard hat lighting system of claim 17, wherein a distance between the two outermost channels is between 50 mm and 150 mm, and a distance between the two medial channels is between 25 mm and 55 mm.

19. The hard hat lighting system of claim 17, further comprising an inlet channel located between a first medial channel and a first outermost channel, wherein the first medial channel and the first outermost channel are located on a first side of the rigid mounting bracket, the inlet channel having a dimension that is smaller than an endcap at one end of the flexible strap, wherein the endcap of the flexible strap is coupled to the inlet channel to capture the flexible strap.

* * * * *